US005121575A

United States Patent [19]

DeGarmo et al.

[11] Patent Number: 5,121,575

[45] Date of Patent: Jun. 16, 1992

[54] SPACERS FOR BLOCK CONSTRUCTIONS TO MAINTAIN THE ALIGNMENT THEREOF

[75] Inventors: James R. DeGarmo; Thomas E. DeGarmo, both of Canton, Ohio

[73] Assignee: PD-12, Inc., Canton, Ohio

[21] Appl. No.: 682,148

[22] Filed: Apr. 8, 1991

[51] Int. Cl.[5] ..... E04B 2/00

[52] U.S. Cl. ..... 52/307; 52/396; 52/402

[58] Field of Search ..... 52/306, 307, 308, 583, 52/396, 400, 235, 402; 446/110, 120, 121, 125

[56] References Cited

U.S. PATENT DOCUMENTS

| | | | |
|---|---|---|---|
| 1,617,033 | 2/1927 | Shields | 52/306 |
| 2,227,842 | 1/1941 | Polivka | 52/308 |
| 2,413,268 | 12/1946 | Unverferth | 52/306 |
| 2,431,384 | 11/1947 | Fischer | 52/396 |
| 3,099,110 | 7/1963 | Spaight | 52/396 |
| 3,234,699 | 2/1966 | Smith | 52/308 |
| 4,114,337 | 9/1978 | Neuhardt | 52/306 |
| 4,610,901 | 9/1986 | Linscott | 52/306 |
| 5,031,372 | 7/1991 | McCluer | 52/307 |

FOREIGN PATENT DOCUMENTS

| | | | |
|---|---|---|---|
| 1564289 | 4/1980 | United Kingdom | 52/396 |

*Primary Examiner*—David A. Scherbel
*Assistant Examiner*—Joanne C. Downs
*Attorney, Agent, or Firm*—Paul E. Milliken; Lee A. Germain

[57] ABSTRACT

This invention provides various configurations of spacers for use in plastic block constructions to prevent relative lateral side-to-side movement between adjacent blocks of the construction when they are connected together with interlockable tab extensions. The spacers are mounted within joint spaces between adjacent blocks of the construction and are in contacting operative engagement with the interlocked tabs to prohibit any relative lateral movement out of alignment between the blocks in the direction towards or away from the frontal or rearward planar faces of the blocks and to retain the blocks aligned in a common plane.

21 Claims, 4 Drawing Sheets

SPACERS FOR BLOCK CONSTRUCTIONS TO MAINTAIN THE ALIGNMENT THEREOF

FIELD OF THE INVENTION

This invention pertains generally to block constructions wherein the blocks are conventionally mounted within window and/or other types of wall openings as stationary structures to allow as much light as possible to pass through the block wall and into the interior of the construction.

More particularly, this invention pertains to plastic block wall constructions wherein each of a plurality of molded plastic blocks is characterized by frontal and rearward faces and each face has a configuration of interlockable tabs which extend outwardly from each corner and in a plane which is parallel to and in close proximity to the plane of each face, the blocks of the construction being interlockingly engaged by the tabs at their commonly junctured corners wherein this invention provides spacer means positioned within the confines of the interlocked tabs to prevent any lateral offset movement between the blocks in a direction of either the frontal or the rearward block faces and thereby retain the blocks in alignment in a common plane.

Specifically, the present invention provides for various configurations of spacers which may be applied to molded plastic block wall constructions in which blocks are interlocked at their corners by tabs extending outwardly from the edges of each frontal and rearward face of the blocks, the spacers operatively engaging interlocking tabs at a common corner within the Juncture of the blocks to prevent the blocks from moving laterally out of alignment relative to each other in the direction of either the frontal or the rearward faces of the blocks.

BACKGROUND OF THE INVENTION

It is well-known in the construction industry to build walls and/or complete window or other types of wall openings of glass blocks which are conventionally mortared together in aligned rows and columns. These type of block wall constructions are used where one wishes to close off a wall opening in a substantially stationary manner but would like to allow as much light as possible to pass through the wall and into the interior of the construction.

U.S. Pat. No. 4,114,337 issued Sep. 19, 1978 to Walther C. Neuhardt describes and illustrates a glass block construction wherein a configuration of spacer means is used within the mortar joints between adjacent blocks to insure a uniform spacing between the blocks during wall construction. The particular spacers are characterized by cross or T-elements which have widths corresponding to the desired distance between adjacent blocks in both vertical and horizontal directions of the construction and these remain within the mortar joints and thus become a functioning and load bearing element of the construction.

In more recent years, replacements for glass block type constructions have been suggested and these comprise lookalike plastic blocks which are molded to include various type of tab members which form part and parcel of the block structure. The tabs are interlocked by various techniques and this is to facilitate maintaining a uniform spacing between adjacent blocks of the construction as well as to stabilize the construction during the time that a worker places a grouting material within and between the joints of adjacent blocks.

U.S. Pat. No. 4,891,925 issued Jan. 9, 1990 to Marlon Carlson et al describes and illustrates a particular plastic block construction wherein a plastic block is characterized by flanges extending around the perimeter of both of the frontal and rearward faces of the block and these will bear against like flanges of adjacent blocks to insure consistent and even spacing between blocks of the construction. The flanges have corner extensions which are characterized by T-shaped cavities and two such extensions of adjacent blocks have their cavities interlocked together by a correspondingly T-shaped member. The T-shaped members are thus used to interlock adjacent blocks together in a unified construction.

More recently, molded plastic blocks have been configured with various type interlocking tabs which extend outwardly from the corners of the block and in planes parallel to the planes of the frontal and rearward face surfaces and the blocks of a construction are locked together when the tabs of adjacent corners are forcefully engaged by a worker as he constructs a block wall structure. Thus, the interlocked tabs not only maintain a uniform spacing between adjacent blocks of the construction but they also function to hold the blocks together in a unified manner.

These more recently configured plastic blocks, while providing an excellent technique for assembling a unified block wall structure, are deficient in that the blocks may be moved laterally out of alignment relative to each other in a direction transversely to the planes of either of the frontal or rearward face surfaces. This misalignment may occur during assembly of a wall or it may occur after such assembly due to wind and/or object impact forces against either of the frontal or rearward faces since the interlocking tab configurations act only in the planes of the frontal and rearward faces to retain the blocks in their spaced relationship to each other. The tab configurations do not act to retain block alignments in the transverse direction of the frontal and rearward faces or, more simply stated, in the lateral direction of the block edgewalls or side face surfaces.

Because of this deficiency, a need exists for a means to prevent block misalignments in the lateral direction of the side faces especially when the blocks include a configuration of tab extensions which are interlocked together during the placement of blocks in a way construction. Further, it is also desirable to be able to connect blocks in a subassembly for transport to a final assembly site without having them shift out of alignment.

It is a primary object of the present invention to provide a spacer means which may be used in plastic block wall constructions to prevent any relative block motion and/or lateral side-to-side movement between adjacent blocks of the construction when such blocks are interlocked together by tab type extensions.

Another object of the invention is to provide an easily manufactured spacer means which may be applied to plastic block constructions, the spacer means being made from the same or similar materials as the blocks whether they are transparent, translucent, and/or opaque to prevent any relative movement between adjacent blocks in a direction parallel to the axis of the spacer means.

A further object of the invention is to provide various configurations of economically manufactured spacer means which may be incorporated into plastic block wall constructions at the time that the blocks are oriented and placed within the wall by a worker such as to prohibit any relative lateral side-to-side movement of adjacently interlocked blocks in the direction of either the frontal and/or rearface surfaces during wall assembly and after such assembly.

A still further object of the invention is to provide a spacer means which will assist in securely fastening a subassembly of blocks together for transporting them to a final assembly site.

These and other objects of the present invention will be more fully apparent and appreciated from a consideration of the specification and attached drawings.

SUMMARY OF THE INVENTION

This invention provides a spacer means for use in combination with a plurality of plastic blocks of a construction wherein each of the blocks exhibits frontal and rearward face surfaces and a configuration of interlockable tabs extending outwardly from each corner in planes parallel to the planes of the frontal and rearward face surfaces and the blocks are in an interlocked engagement at the juncture of their corners, the spacer means being positioned within a space at the corner juncture of the interlocked blocks and characterized by an axial length which spans the inside distance between interlocked frontal face tabs and interlocked rearward face tabs and having end surface areas of a sufficient extent as to effect a contacting engagement with at least a portion of each of the interlocked tabs, said spacer means effectively prohibiting any relative lateral movement of the block side faces of adjacently interlocked blocks in a direction parallel to the axis of the spacer means.

BRIEF DESCRIPTION OF THE DRAWINGS

For a complete understanding of the invention, reference should be made to the following detailed description and to the accompanying drawings, in the several figures in which like-reference numerals indicate like elements and wherein.

DETAILED DESCRIPTION OF THE INVENTION

Figure 1:
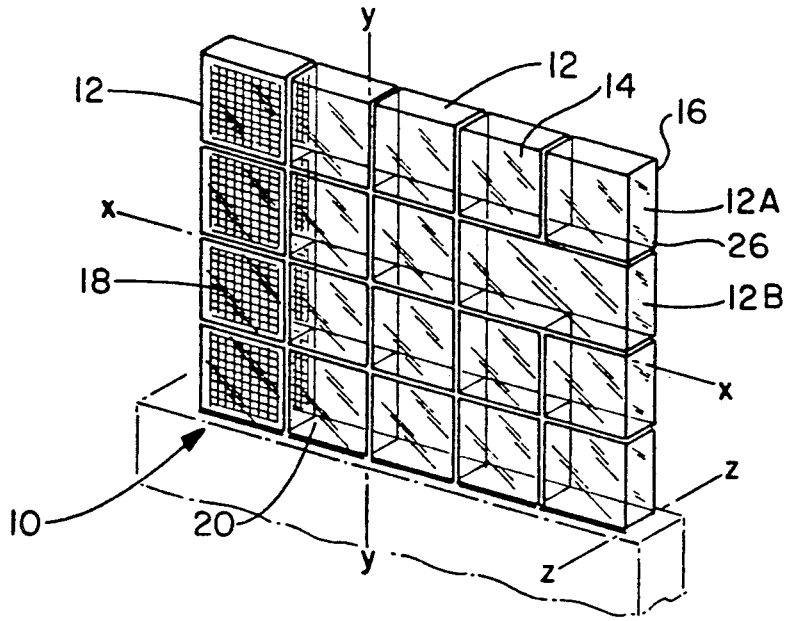
FIG. 1 is a perspective view of a plastic block wall construction as may be applied to the present invention.

Referring to FIG. 1 of the drawings, a perspective view of a block wall construction is shown and generally indicated by reference numeral 10. Conventionally, the wall would be comprised of a plurality of glass blocks, however, in accordance with the present invention, the wall 10 is constructed of a plurality of plastic blocks 12 which may be manufactured as square blocks 12A or in rectangular sizes as indicated at 12B. In either configuration, the blocks 12 are positioned in rows along the x—x axis and in columns along the y—y axis. The frontal face surfaces 14 and the rearward face surfaces 16 of the blocks 12 are those which would be seen by a viewer looking in the direction of the z—z axis, i.e., a viewer would normally be looking through the substantially transparent wall 10 in the direction of the z—z axis. In this respect and for the purposes of this description, the frontal face surface 14 will always be the surface nearest the viewer while the rearward face surface will be the opposite face surface, and this, irrespective of whether the viewer is positioned on the inside of a structure formed by the wall 10 or on the outside of the structure.

The plastic blocks 12 may be made such that the faces 14 and 16 exhibit decorative patterns as indicated at reference numeral 18. The pattern 18 will normally be molded into the inside of the block 12 such that the outside face surfaces are planar surfaces. In other words, while the block faces 14 and 16 may exhibit a relief pattern, the pattern is formed on the inside of the block and the outside face surfaces are plane surfaces.

While, as mentioned, the blocks 12 may be made to be substantially transparent, i.e., they allow forms and the colors of objects beyond to be seen through the blocks, they may also be made with varying patterns and/or densities of patterns to the extent to be translucent. If the blocks are translucent, they will allow light to pass through but forms and colors of objects beyond cannot be easily distinguished. Further, the blocks 12 may be made in various colors, color patterns, and/or color densities to the extent that they are opaque, i.e., no light will pass through. Furthermore, the blocks 12 may be made of various plastic resin materials which will meet the requirements of such type wall constructions and it is well within the knowledge and technology of this type of plastic block manufacture. Preferably, the blocks 12 will be made of an appropriate acrylic plastic resin material such as, for example, LEXAN (a tradename of General Electric Corporation). In any event, the present invention is not considered limited in any way to the particular material which comprises the plastic blocks 12 or to the multiple variations in which such blocks may be made, suffice to say that, the blocks are comprised of a suitable plastic material meeting the requirements for the particular application.

Figure 2:
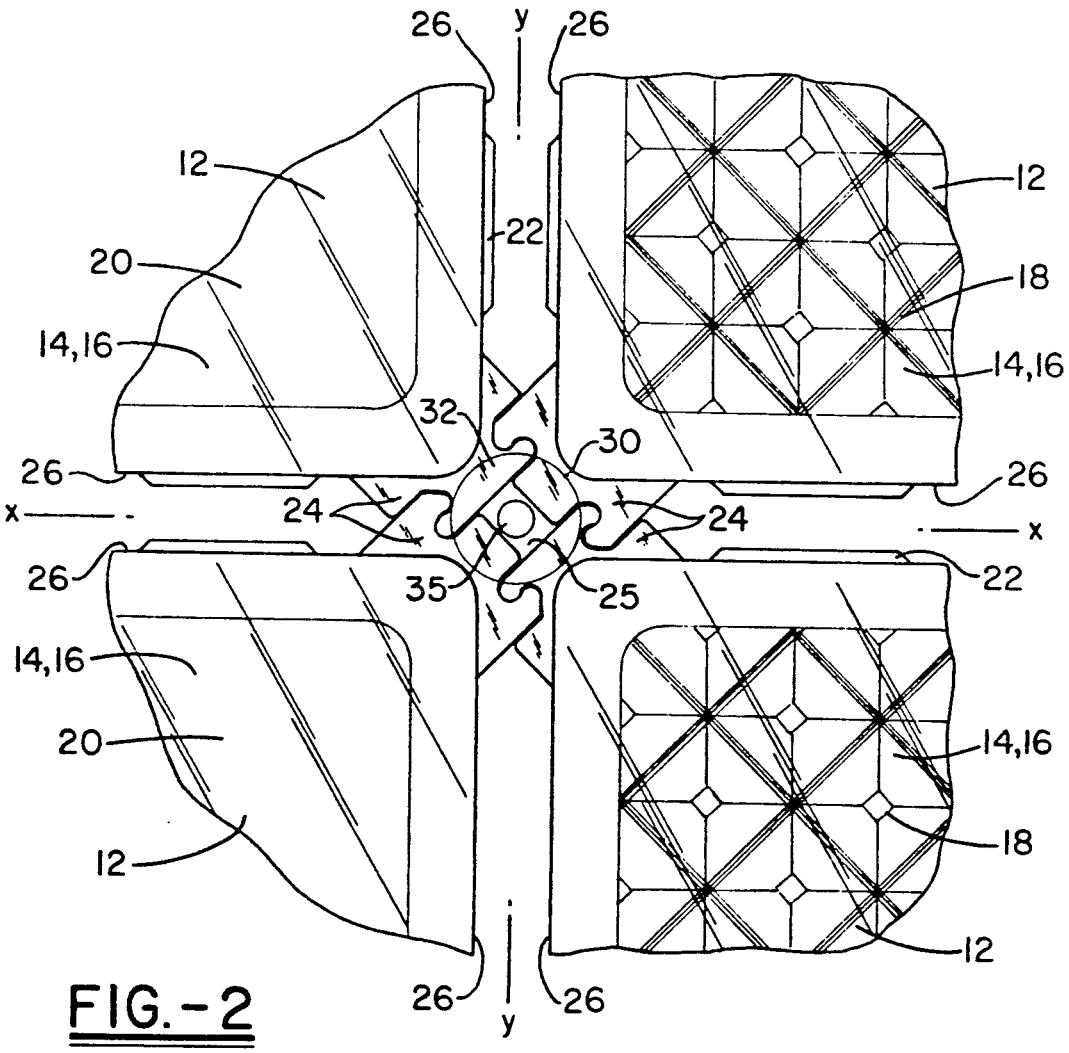
FIG. 2 is a frontal and/or rearward elevational view, partially broken away, of a four block set in a plastic block wall construction showing an interlocking tab configuration incorporating the concepts of the present invention.

Continuing with reference to FIG. 1 and now also to FIG. 2 of the drawings, the plastic blocks 12 may be made with a plurality of side flanges 22 which may, or may not, be for the purpose of establishing and maintaining a clearance between the adjacent blocks of a construction. More particularly, the blocks 12 will be made with a configuration of tab extensions 24 which are molded as an integral part of the block structure in the manufacture of the blocks. The tabs 24 may be designed in various known configurations and a particular one such configuration is illustrated in FIG. 2. According to the particular configuration shown, the tabs 24 are such that they may be forced into locking engagement in either of the x—x and/or y—y directions. This will obviously be very advantageous for a worker when building a block wall construction as shown in FIG. 1. Clearly, the blocks 12 will be automatically positioned in spaced relationship in both of the x—x and y—y directions by the very design of the interlocking tabs 24.

It should be obvious from the showing in FIG. 2 that, while the blocks 12 may be integrally interlocked together in both the x—x and y—y directions by the tabs 24, a relative movement between adjacent blocks may be effected in the z—z direction (the direction in and out of the drawing). In other words, the interlocked tabs 24 will prohibit relative movement between the blocks toward and away from each other in the plane of the frontal and/or rearward surfaces 14 and 16 but will not prevent lateral movement in the orthogonal direction which is the direction in the plane of the side surfaces or edgewalls which are indicated at reference numeral 26. This may be a great disadvantage to a worker trying to apply grouting material to the joints between adjacent blocks as the force of the grouting may push the blocks apart in the z—z direction. In a worse case scenario the block wall construction may be forced inwardly and/or outwardly to the extent that the wall. or a portion of it, may be toppled. This undesirable lateral side-to-side movement between adjacent blocks may occur due to excessive wind and/or object impact forces against either of the frontal or rearward surfaces of the blocks.

Figure 3:
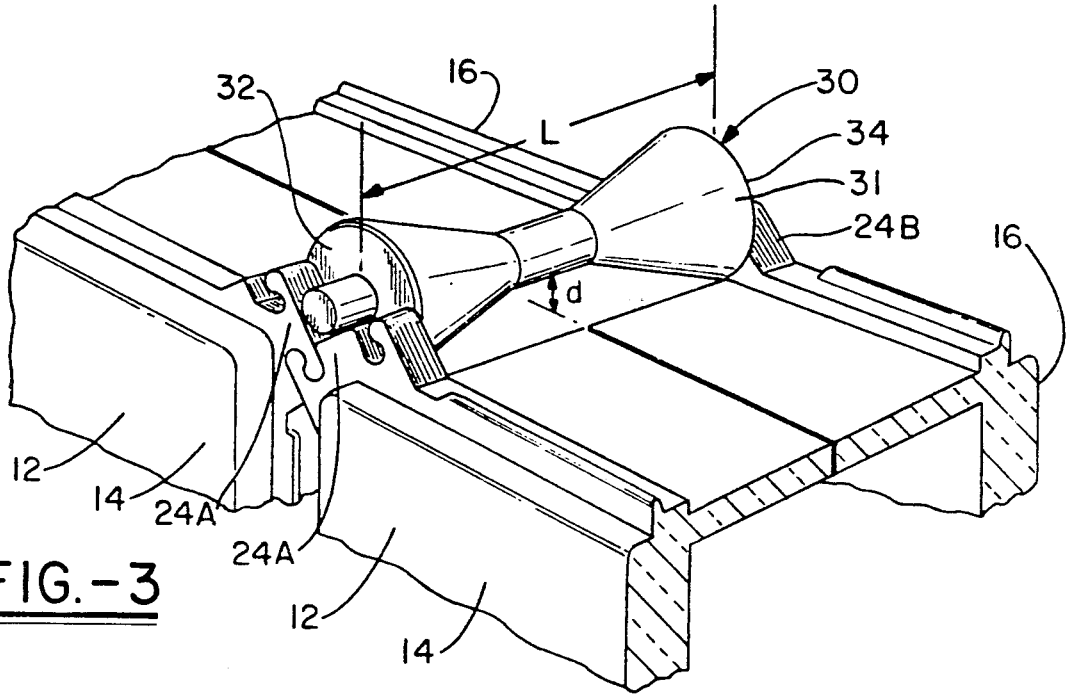
FIG. 3 is a perspective view, partially broken away and in cross-section, of a two block set showing interlocking corner tabs and a spacer means according to a preferred embodiment of the invention as it may be applied to preventing relative movement between the blocks in the axial direction of the spacer.

The present invention solves the above-described problem associated with interlockable plastic block wall constructions by the provision of an easily mountable spacer means which interacts with the interlockable tabs 24 in a way to prevent block movement in the z—z direction of the blocks. A preferred embodiment of the spacer means is illustrated in FIGS. 3 and 4 of the drawings. the spacer means being indicated generally by reference numeral 30.

The spacer means 30 has a body member 31 characterized by an axial length "L" which is substantially equal to the distance as measured between the inside of the frontal interlocked tabs indicated at 24A and the rearward interlocked tabs indicated at 24B. The frontal interlocked tabs 24A are, of course, extensions of the frontal face surface 14 in a plane parallel to the frontal surface and the rearward interlocked tabs 24B are extensions of the rearward face surface 16 in a plane parallel to the rearward surface.

The spacer means 30 is further characterized by end surfaces indicated at 32 and 34 which have area extents which are sufficient enough to engage at least a portion of each of the interlocked tabs 24 of both frontal and rearward tabs 24A and 24B respectively. A spacer means 30 which exhibits end area extents 32 and 34 which are substantially circular is shown in FIG. 2 of the drawings. In this respect also, it will be recognized that the geometric configuration of the spacer ends 32,34 may be a square area and this is shown more clearly in FIG. 10 of the drawings by the primed reference numerals. Obviously, in either configuration of the end surface areas 32,34, each of the interlocked tabs 24 is at least partially engaged by the end of the spacer 30.

Figure 4:
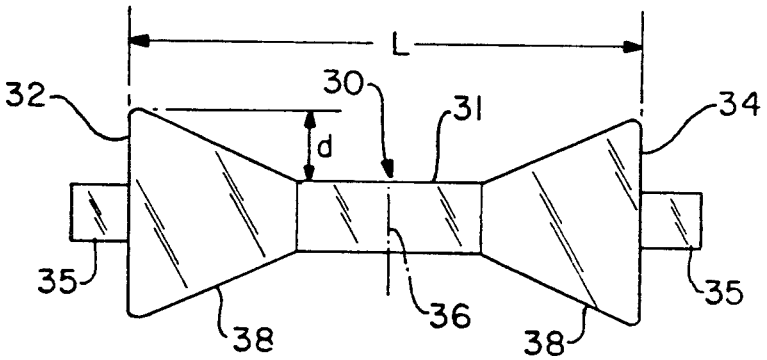
FIG. 4 is an elevational view of the spacer means shown in FIG. 3.

In FIG. 4 of the drawings, the spacer 30 is shown in an elevational view and it comprises ends 32,34 which recede towards a midpoint of the spacer body 31 as indicated at reference numeral 36. While the receding portions of the spacer which are indicated at numeral 38, may be angled to the exact midpoint 36, they may as well exhibit greater angles and intersect at a point substantially short of the midpoint 36 as indicated in the drawing. In any event, the portions 38 add reinforcements to the spacer body 31 such that it may not be easily collapsed in the axial or longitudinal direction of the spacer. The amount of reinforcement, of course, will be dictated by the strength of the material which comprises a spacer means. In this respect also, it will be recognized that the spacer means 30 and any of the subsequently described embodiments thereof, may be comprised of any type of material and/or composite which will meet the needs of the invention. These may vary from a completely transparent spacer means at the one extreme to a completely opaque spacer means at the other extreme and this, of course, will be dictated by the type of material which comprises the spacer means. This invention, therefore, is not considered limited in any way to the material composition of the spacer means and/or its ability to transmit light therethrough.

Figure 10:
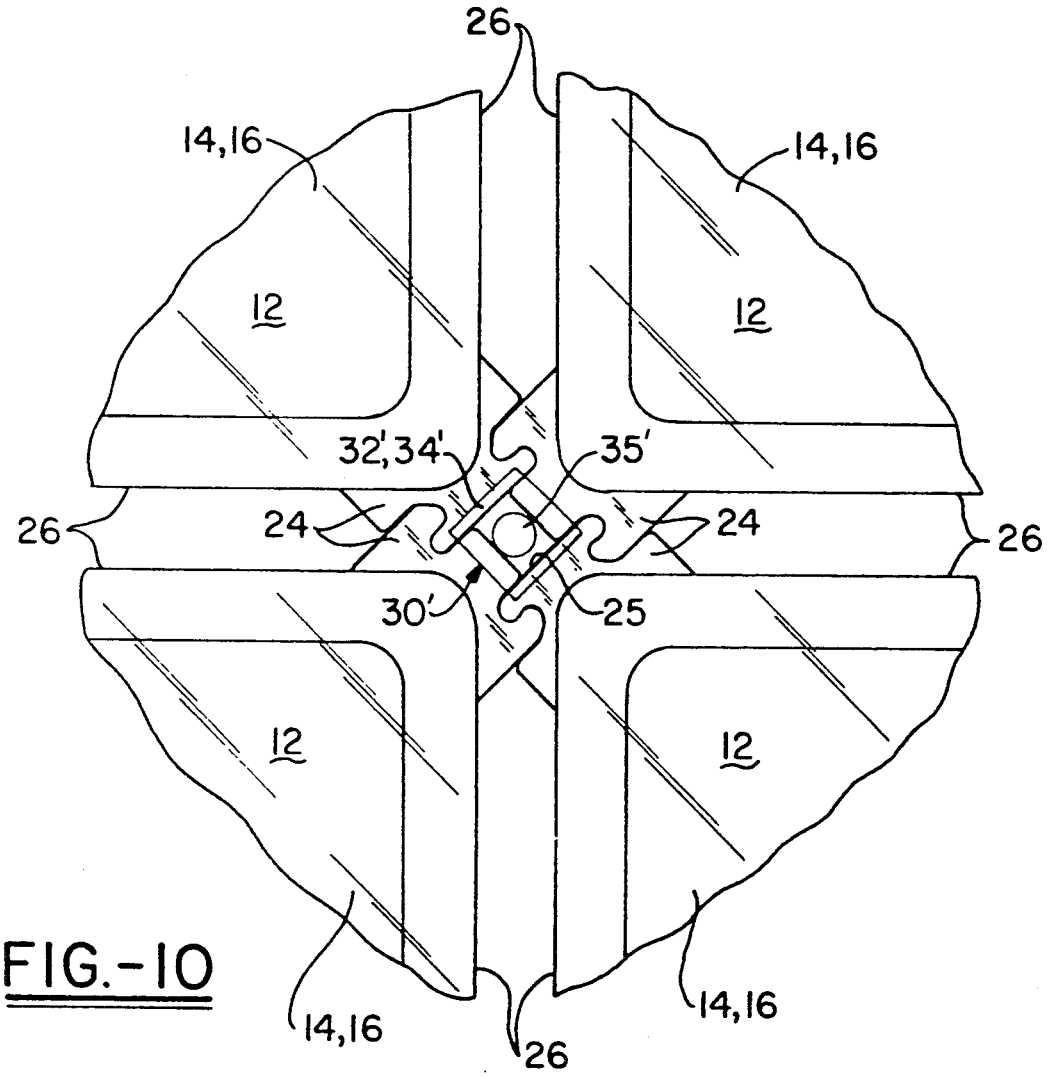
FIG. 10 is a frontal and/or rearward elevational view similar to FIG. 2 illustrating an alternative configuration for the spacer end area extents which may be applied to all of the embodiments shown in the drawings.

Further with respect to FIGS. 2, 3, and 4, the spacer means 30 may also comprise axial peg-shaped end extensions 35 which may be seated within a cavity formed by the ends of interlocking tabs 24. This cavity is indicated in FIGS. 2 and 10 of the drawings at reference numeral 25 and the shape of the cavity is particular to the type of interlockable tabs 24 shown in the drawings. In most cases of interlockable tabs the cavity 25 will be substantially rectangular in configuration by the very fact that such tabs 24 are interlocked at a juncture of block corners and, therefore, spacer end extensions 35 which are substantially circular in transverse cross-section may be carried within the cavity 25 with the least amount of interference. From the illustrations of FIGS. 2 and 10, it will be appreciated that the spacer means 30 will be suspended within the corner juncture space between the blocks 12 by the engagement of the end extensions 35 within the cavities 25 formed by the frontal interlocked tabs 24A and the rearward interlocked tabs 24B. In this respect, the spacer means 30 will not actually engage any portion of the block bodies except for the interlocked tabs 24. This is an advantage because the end surface areas 32 and 34 may be made much smaller and still be capable of engaging at least a portion of each of the tabs 24 of each of the corner junctured blocks 12.

In the alternative configuration, i.e., without end extensions 35, it can be seen that the spacer 30 will be positioned to rest on the lower two blocks 12 and that the end surfaces 32 and 34 will have to be greater in area extent so as to engage all of the interlocked tabs 24. The preferred embodiment of the spacer means 30 includes end peg-shaped extensions 35 when a tab-formed cavity 25 exists at the corner juncture of interlockable tabs 24. An additional advantage of a spacer 30 being carried within centrally located cavities 25 by end extensions 35 is, that a spacial distance indicated at "d" exists in both of the horizontal x—x and vertical y—y directions of the interlocked blocks 12. This will allow for wiring and the like to be located within the block wall construction and these may traverse the spacial cavities between adjacent blocks in either of the horizontal or vertical directions without being obstructed by the spacer means 30.

Figure 5:
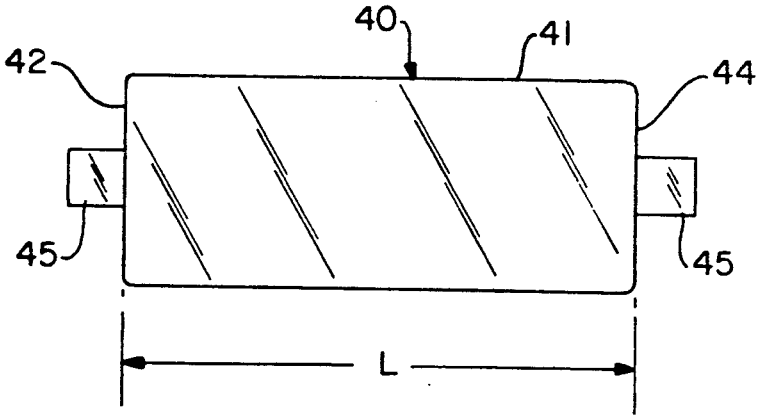
FIG. 5 is an elevational view of another embodiment of a spacer means as may be applied to this invention.

FIG. 5 of the drawings illustrates another embodiment of a spacer means and it is generally indicated at reference numeral 40. The spacer 40 is characterized by a body member 41 having an axial length "L" between end surfaces 42 and 44 that is substantially equal to the distance as measured between the frontal and rearward interlocked tabs 24 in the same manner as the spacer 30. The spacer 40, however, exhibits the same transverse cross-sectional configuration throughout its length "L". Obviously, the cross-sectional configuration may be circular as illustrated in FIG. 2 of the drawings or, it may be square as illustrated in FIG. 10. Further, the spacer 40 may include end peg-shaped extensions 45 and these are intended to engage tab-formed cavities 25 in the same manner as the extensions 35 of the spacer 30.

Figure 6:
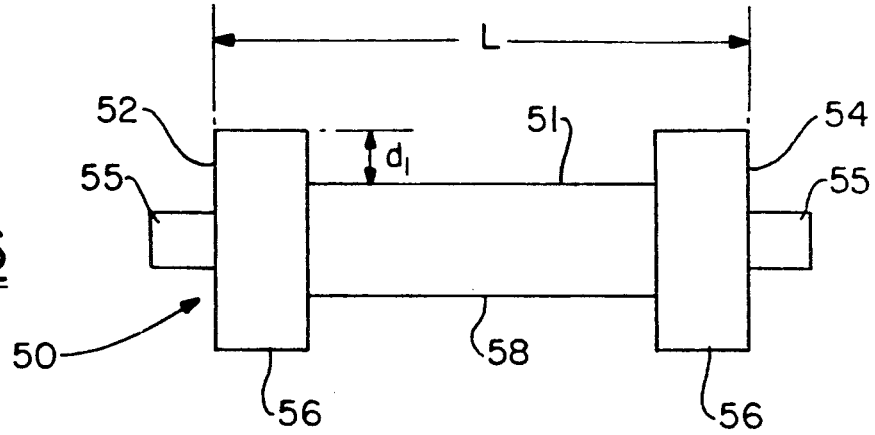
FIG. 6 is an elevational view of another embodiment of a spacer means as may be applied to this invention.

FIG. 6 of the drawings illustrates another embodiment of a spacer means and it is generally indicated at reference numeral 50. The spacer 50 is characterized by a body member 51 which also has the same axial length "L" as the embodiments 30 and 40, however, it is characterized by end surfaces 52 and 54 which are backed by reinforcement material 56 having the same cross-sectional configuration as exhibited by the plane area extents of the end surfaces. The mid-portion of the spacer indicated at 58 may, or may not, have the same cross-sectional configuration as the portions 56 but it will be somewhat smaller so as to provide a spacial distance "$d_1$" which will function in the same manner as the spacial distance "d" described with reference to the spacer means 30. The spacer 50 may also be characterized by end peg-shaped extensions 55 which will function in a similar manner as the end extensions 35 and 45 hereinbefore described.

Figure 7:
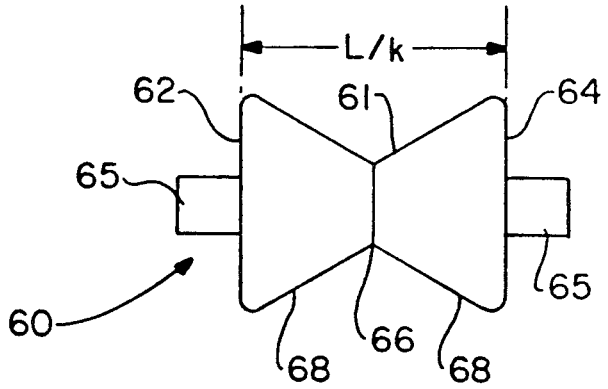
FIG. 7 is an elevational view of a spacer embodiment as may be applied to blocks exhibiting a shorter side section, the section being taken from the frontal face surface to the rearward face surface of the block.

FIG. 7 illustrates another embodiment of the spacer and it is generally indicated by reference numeral 60. The spacer 60 may be applied to blocks 12 exhibiting a thinner cross-section as measured from the frontal face surface 14 to the rearward face surface 16 and this will be somewhat less than the standard thickness for such blocks. In this respect, the axial length of the spacer body member 61 will be "L/k" where "k" is a variable which determines the actual block thickness dimension. The spacer 60 is also characterized by end surface areas 62 and 64 which are reinforced by tapered portions indicated at 68 which meet at the approximate midpoint 66 of the spacer body 61. The spacer 60 may also include end pegshaped extensions 65 which will mount the spacer between the frontal and rearward interlocked tabs 24 in a cavity 25 when such cavity exists. Obviously, the surface area extents of the end surfaces 62 and 64 may be circular as illustrated in FIG. 2 or square as illustrated in FIG. 10 of the drawings.

Figure 8:
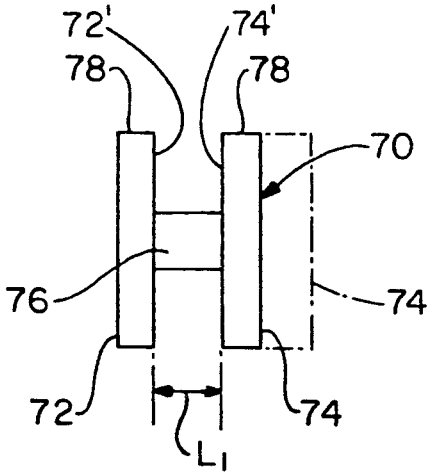
FIG. 8 is an elevational view of still another embodiment of a spacer means as may be applied to the invention.
Figure 9:
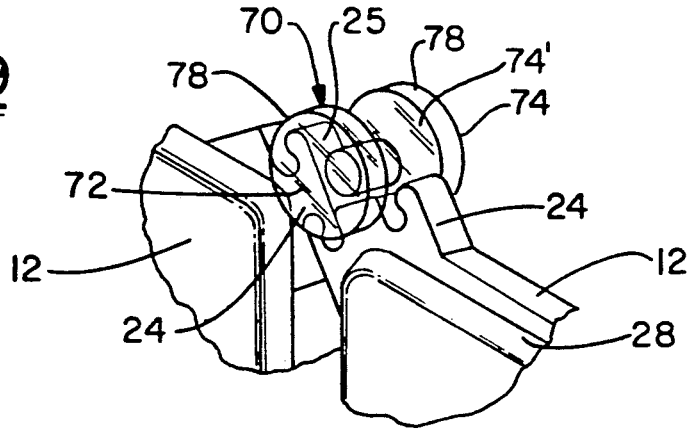
FIG. 9 is a perspective view, similar to FIG. 3, and illustrating the application of the embodiment shown in FIG. 8.

FIGS. 8 and 9 of the drawings illustrate a spacer means 70 which does not exhibit an axial length "L", i.e., the spacer does not span the inside distance as measured between frontal and rearward interlocked tabs 24. The spacer 70 is characterized by ends 78 which are joined by a mid-section member 76 and the axial length between the ends 78 is "$L_1$" which is substantially equal to the dimension as measured between the inside and outside faces of the interlocked tabs 24. As clearly shown in FIG. 9, the spacer 70 is positioned within the cavity 25 formed by the ends of the interlocked tabs 24 and the ends 78 capture the engaged portions of the tabs between them. The end surfaces 72 and 74 will have area extents which may be circular or square as illustrated in FIGS. 2 and 10 and the inside surfaces indicated at 72' and 74' will engage at least a portion of each of the interlocked tabs 24 in the same manner as hereinbefore described with reference to the spacers 30, 40, 50, and 60. The spacer 70 may be configured with end portions 78 having the same or different axial dimensions and this is indicated in FIG. 8 by the ghost dot-dashed line extension of the inside-facing surface 74. The end portion 78 having the outside-facing surface 72 will be limited in its axial extent by the fact that it will be positioned within the joint area between adjacent blocks 12 which normally carries the grouting material. The joint area is indicated in FIG. 9 by the numeral 28 and it should be appreciated that one would not want the end portion 78 which faces outwardly to extend axially a greater distance than that of the frontal face surface 14 of a block 12.

Finally, it should be understood that the applicants anticipate that various other block configurations may be made and these may be interlocked by tab type extensions 24. For example, the blocks 12 may be formed in an equilateral triangular configuration having interlockable tabs at the corners. Further, the blocks 12 may be formed in a hexogonal configuration or any other polygonal shape which may be used for wall constructions and these may be interlocked in similar manner by a plurality of tab type extensions. This invention, therefore, is considered to apply to any of the viable block configurations which may be made of a plastic material and which include interlockable tab extensions.

While certain representative embodiments and details have been shown and described for the purpose of illustrating the present invention, it will be apparent to those skilled in the art that various changes and/or modifications may be made thereto without departing from the spirit or scope of the inventive concept.

What is claimed is:

1. A spacer for use in combination with a plurality of plastic blocks of a construction wherein each of the blocks exhibits frontal and rearward face surfaces and a configuration of interlockable tabs extending outwardly from and lying in a plane parallel to the planes of the frontal and rearward face surfaces and in an interlocked engagement to form a unitary block construction, said spacer positioned within a space at the juncture of the interlocked blocks and having a body characterized by an axial length which spans the inside distance between the interlocked frontal face tabs and the interlocked rearward face tabs and having end surface areas of an extent which effects contacting engagement with at least a portion of each of the interlocked tabs, said spacer effectively prohibiting any relative movement between adjacently interlocked blocks in a direction parallel to the axis of the spacer.

2. The spacer as set forth in claim 1 characterized by end surface area extents which are substantially circular.

3. The spacer as set forth in claim 1 characterized by end surface area extents which are substantially rectangular.

4. The spacer as set forth in claim 3 characterized by end surface area extents which are square.

5. The spacer as set forth in claim 2 characterized by end surface area extents which are greater than the transverse cross-sectional area between the ends.

6. The spacer as set forth in claim 3 characterized by end surface area extents which are greater than the transverse cross-sectional area between the ends.

7. The spacer as set forth in claim 1 characterized by axial peg-shaped extensions at each end which may be carried within a cavity defined by the limit extents of the frontal and rearward interlocked tabs such that the spacer body is in no contacting engagement with any portion of a block.

8. The spacer as set forth in claim 7 characterized by end surface area extents which are substantially circular.

9. The spacer as set forth in claim 7 characterized by end surface area extents which are substantially rectangular.

10. The spacer as set forth in claim 9 characterized by end surface area extents which are square.

11. The spacer as set forth in claim 1 characterized by comprising a substantially transparent material.

12. The spacer as set forth in claim 1 characterized by comprising a substantially translucent material.

13. The spacer as set forth in claim 1 characterized by comprising a substantially opaque material.

14. A spacer for use in combination with a plurality of plastic blocks of a construction wherein each of the blocks exhibits frontal and rearward face surfaces and a configuration of interlockable tabs which extend outwardly from locations close to the face surfaces and lying in a plane that is parallel to the planes of the frontal and rearward face surfaces and tabs of adjacently positioned blocks are in interlocked engagement to form a unitary block wall structure, said spacer characterized by a body having end portions at the extents of its axial length which define a core portion between the two ends, the core portion being carried within a cavity formed by outer edges of interlocked tabs and the end portions effect a contacting engagement with at least a portion of each of the interlocked tabs to prohibit any relative movement between adjacently interlocked blocks in a direction parallel to the axis of the spacer.

15. The spacer as set forth in claim 14 characterized by end portions having surface area extents adjacent the core portion that are substantially circular.

16. The spacer as set forth in claim 14 characterized by end portions having surface area extents adjacent the core portion that are substantially rectangular.

17. The spacer as set forth in claim 16 characterized by end portions having surface area extents that are square.

18. The spacer as set forth in claim 14 characterized by end portions having different axial dimensions.

19. A spacer for use in combination with an assembly of blocks wherein each block has a pair of substantially parallel oppositely facing surfaces joined together by transversely extending edgewalls, each of the blocks being joined to any adjacent block by interlocking tabs extending from each corner of each block, said tabs lying in a plane that is substantially parallel to the plane of one of the two oppositely facing surfaces, the edgewalls defining a void at each corner juncture of the interlocked blocks, said spacer comprising:

(A) a body member of sufficient length to span the distance between interlocked tabs which are adjacent to the oppositely facing surfaces;

(B) said body member being of a lateral dimension which will fit within the void at each corner juncture of the block assembly; and (C) said body member having sufficient outwardly facing surface area on each end thereof, to engage the inwardly facing surface on all of the interlocking tabs at the corner juncture at which it is positioned and to hold all the interlocking tabs in a common plane thereby preventing the blocks from shifting transversely with respect to each other.

20. The spacer as claimed in claim 19 including a retaining means extending from each end of the body member to engage each set of adjacent interlocking tabs to retain the spacer in a substantially centered operative position within the void in which the spacer is located.

21. The spacer as claimed in claim 20 wherein the retaining means is a pin-shaped member extending from each end of the body member through a void between each adjacent set of interlocked tabs.

* * * * *